US006425159B1

(12) United States Patent
Chen

(10) Patent No.: US 6,425,159 B1
(45) Date of Patent: Jul. 30, 2002

(54) BATHING CLEANER

(76) Inventor: Yi-Chun Chen, 5F, No. 168, Sec. 5, Nan-Ching E. Rd., Taipei (TW)

( * ) Notice: Subject to any disclaimer, the term of this patent is extended or adjusted under 35 U.S.C. 154(b) by 0 days.

(21) Appl. No.: 09/571,885

(22) Filed: May 15, 2000

(51) Int. Cl.[7] ..... A47K 7/02
(52) U.S. Cl. ..... 15/118; 15/209.1; 15/229.11
(58) Field of Search ..... 15/118, 208, 209.1, 15/229.11, 244.3

(56) References Cited

U.S. PATENT DOCUMENTS 5,787,542 A * 8/1998 Chien ..... 15/244.3
5,983,435 A * 11/1999 Osborne ..... 15/209.1
6,161,246 A * 12/2000 Trachtenberg ..... 15/209.1 X

* cited by examiner

*Primary Examiner*—Mark Spisich
(74) *Attorney, Agent, or Firm*—Bacon & Thomas

(57) ABSTRACT

A bathing cleaner comprises a bathing ball and a face cleaner, wherein the face cleaner is provided with a stretchable device. The face cleaner may be detachably fastened to the bathing ball by taking advantage of the stretchable device so that a user can use the bathing ball and the face cleaner to rub and clean his body or face separately or combinedly, and moreover, he may fasten his hair with the stretchable device of the face cleaner when bathing.

1 Claim, 5 Drawing Sheets

BATHING CLEANER

BACKGROUND OF THE INVENTION

This invention relates generally to a bathing appliance, more particularly, it relates to a bathing cleaner composed of a bathing ball and a face cleaner, which can be implemented combinedly or separately, or serving as a hair fastener.

Taking a bath is known an effective relaxant for reducing working pressure in daily life. People, in early days, usually took soap or the like for cleaning their bodies when bathing. The soap itself, however, doesn't rub and clean the skin because of its slippage, and meanwhile, if it is not kept dried, it'll be softened and consumed quickly. This defect hasn't been improved until debut of the bathing cream later on, which is usually loaded in a plastic bottle and squeezed to dispense a proper quantity each time to a bathing ball, then twisted and kneaded to create ample bubble for rubbing and cleaning a user's body. Besides, a face cleaner consisting of a brush portion 22 and a shackle 23 shown in FIG. 1 is also popular, which is used by hitching the shackle 23 with one hand or holding the brush portion 22 directly, however, the face cleaner is not designed for combination with the bathing ball, each is used separately, namely the face cleaner for face-cleaning while the bathing ball for body-cleaning.

SUMMARY OF THE INVENTION

The primary object of this is to provide a bathing cleaner comprising a bathing ball and a face cleaner, wherein the bathing ball and the face cleaner may be combined together for body-cleaning, or, detached for cleaning a user's face and body respectively, and further, a stretchable device of the face cleaner may be used for fastening the user's hair when bathing.

In order to realize abovesaid object, the face cleaner comprises a brush portion and the stretchable device, wherein the face cleaner may be fastened to the bathing ball by hitching the stretchable device to the latter for rubbing and cleaning a user's body, or the face cleaner is detached from the bathing ball for face-cleaning only and for fastening the user's hair by hitching the stretchable device.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention to be made later are described briefly as follows in which.

DETAILED DESCRIPTION OF THE PREFERRED EMBODIMENT

Figure 1:
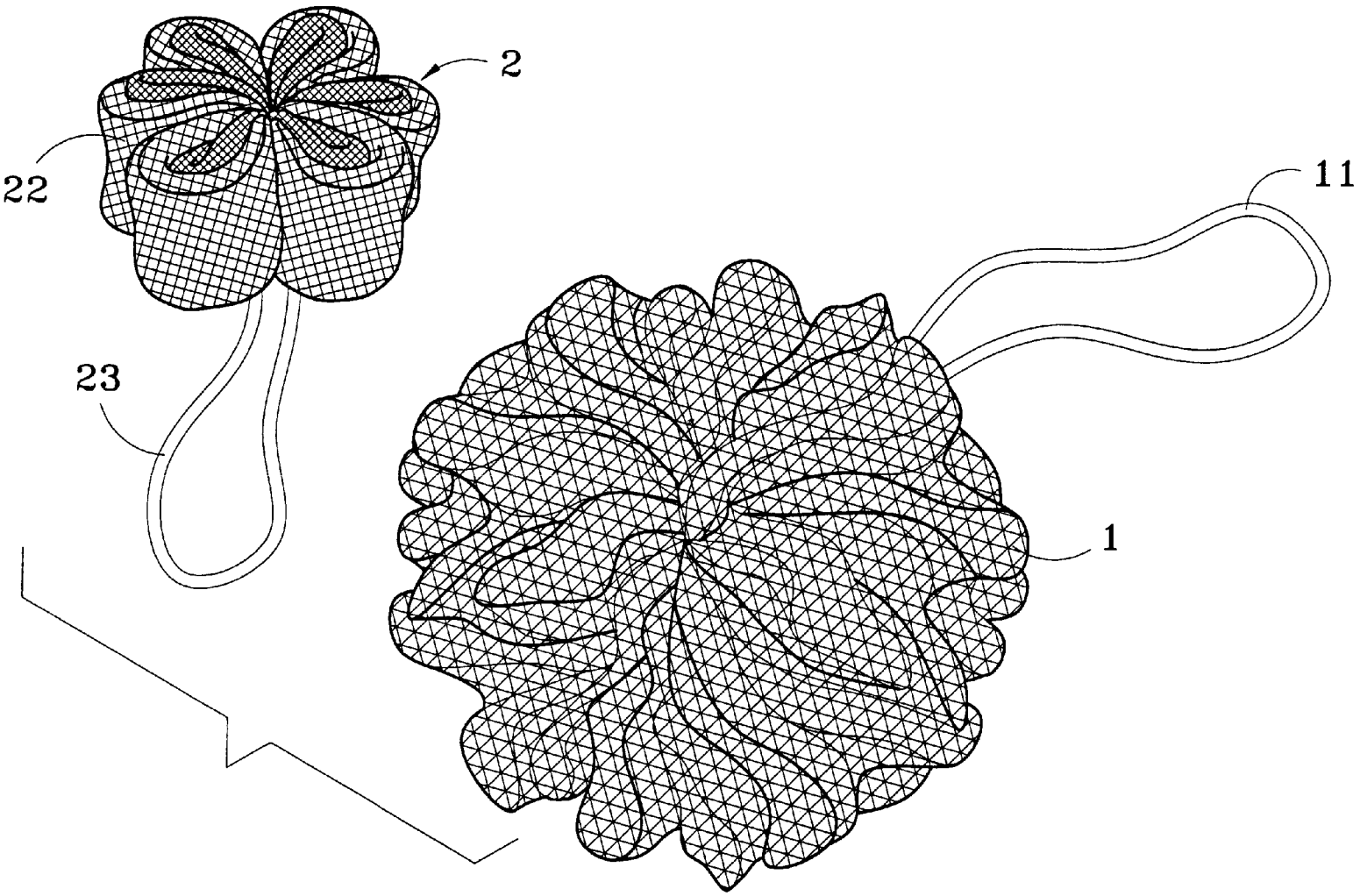
Fig. 1 PRIOR ART
FIG. 1 is a schematic view showing a bathing ball and a face cleaner of a conventional kit.
Figure 2:
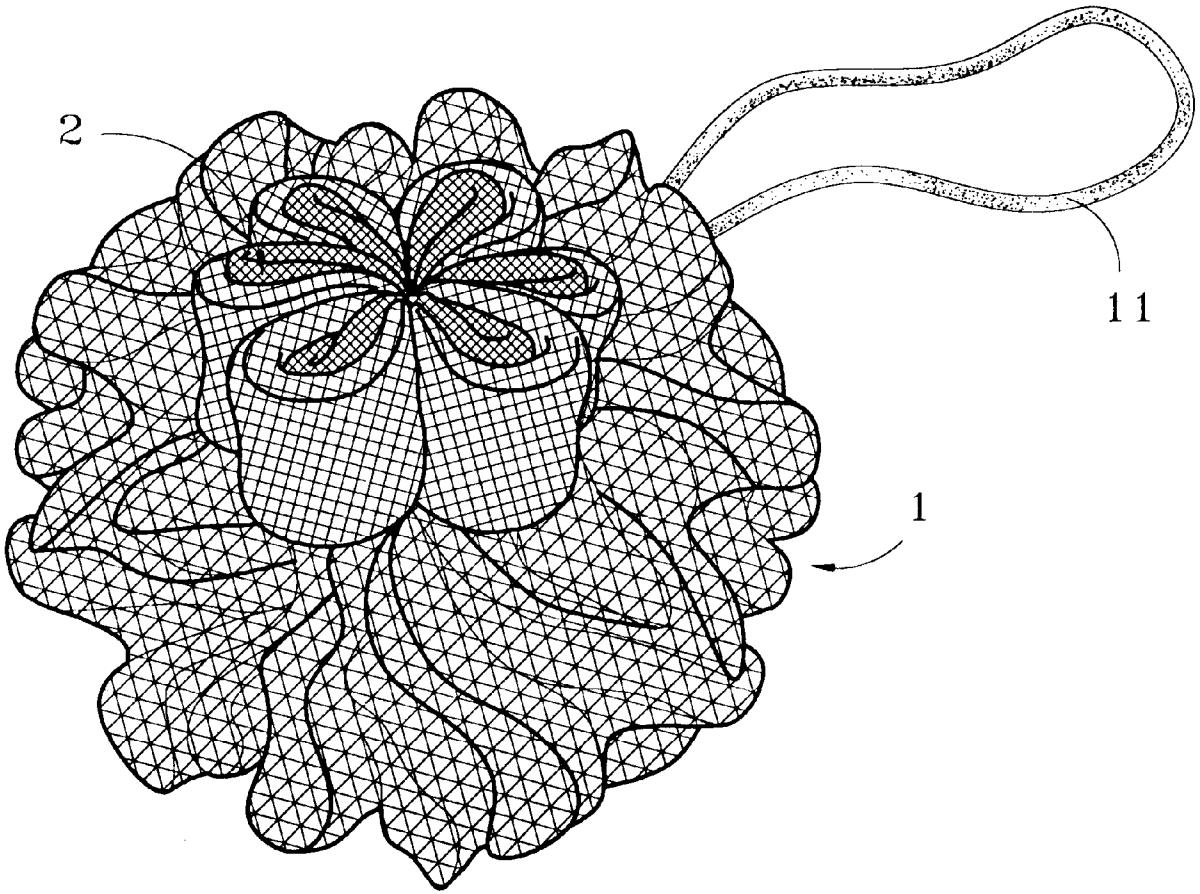
FIG. 2 is an elevational schematic view of this invention in three dimensions.
Figure 3:
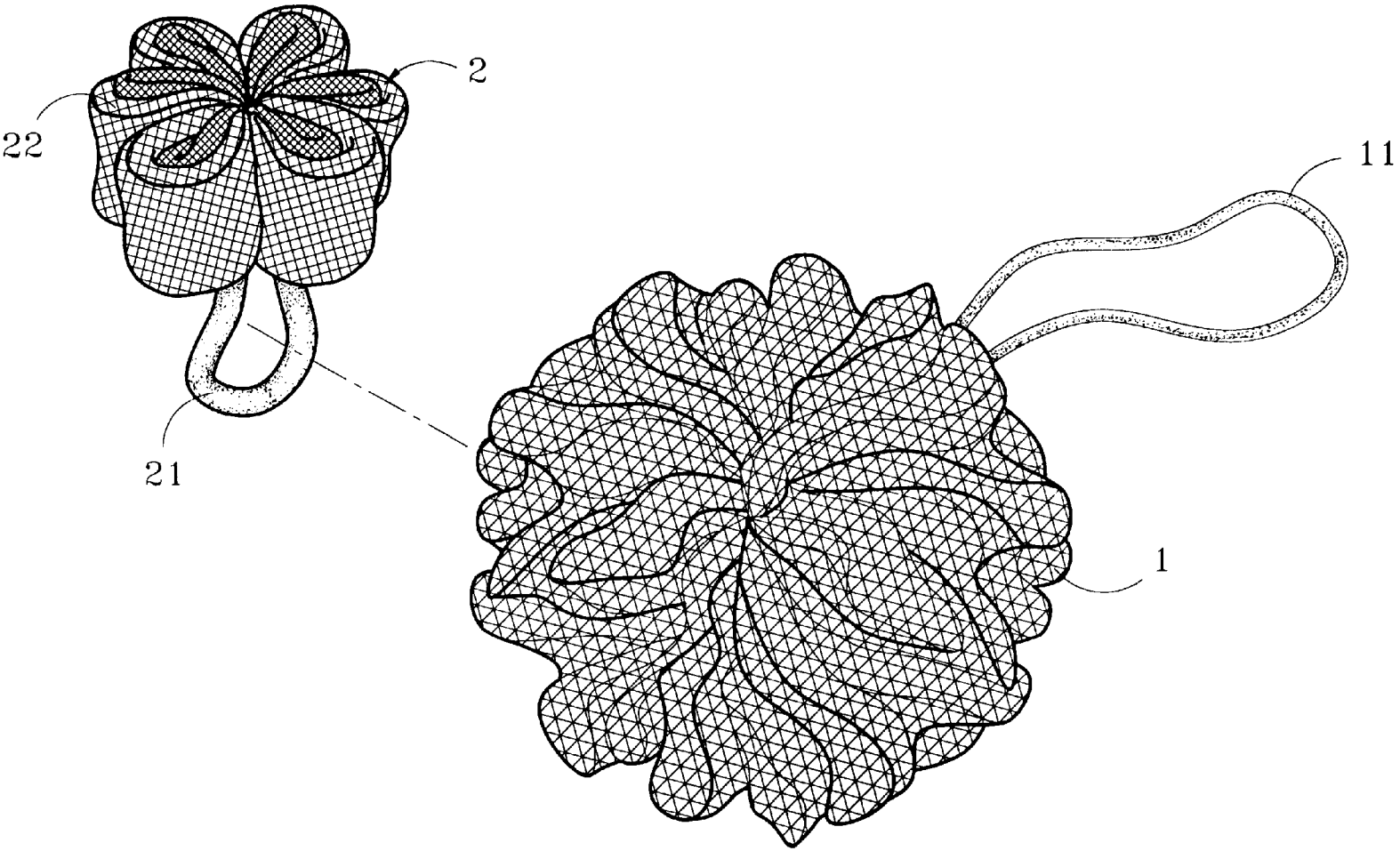
FIG. 3 indicates an exploded structure of this invention.

As shown in FIG. 2 and FIG. 3, an elevational view and an exploded view of this invention, a bathing cleaner comprises a bathing ball 1, which is a swollen irregularly shaped body provided with a shackle 11, and a face cleaner 2 composed of a stretchable device 21 and a brush portion 22. The brush portion 22 knitted in a regular pattern is detachably combined with the bathing ball 1 by taking advantage of the stretchable device 21, and thereby a user may use the bathing ball 1 for cleaning his body and the face cleaner for cleaning his face, or, the combination of the face cleaner 2 and the bathing ball 1 for body-cleaning.

Figure 4:
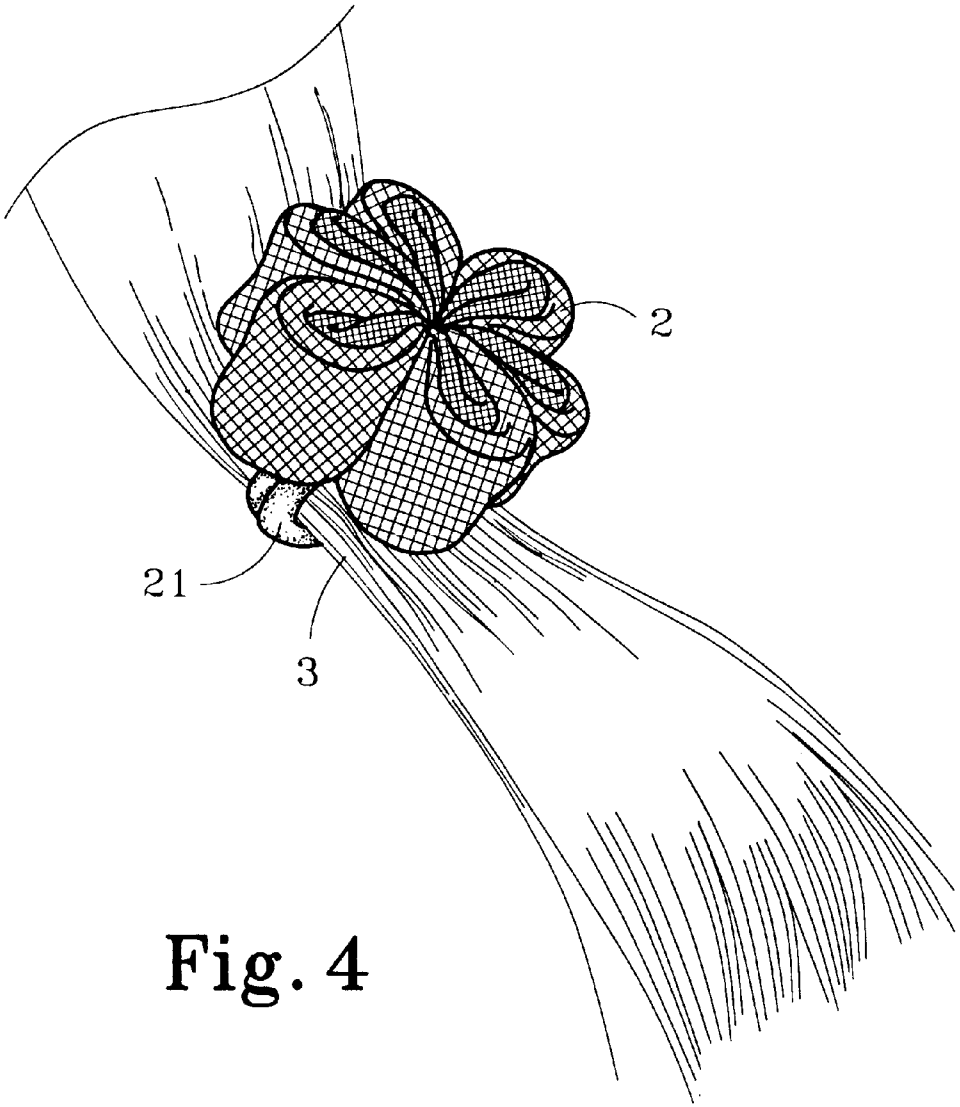
FIG. 4 illustrates an embodiment of this invention.
Figure 5:
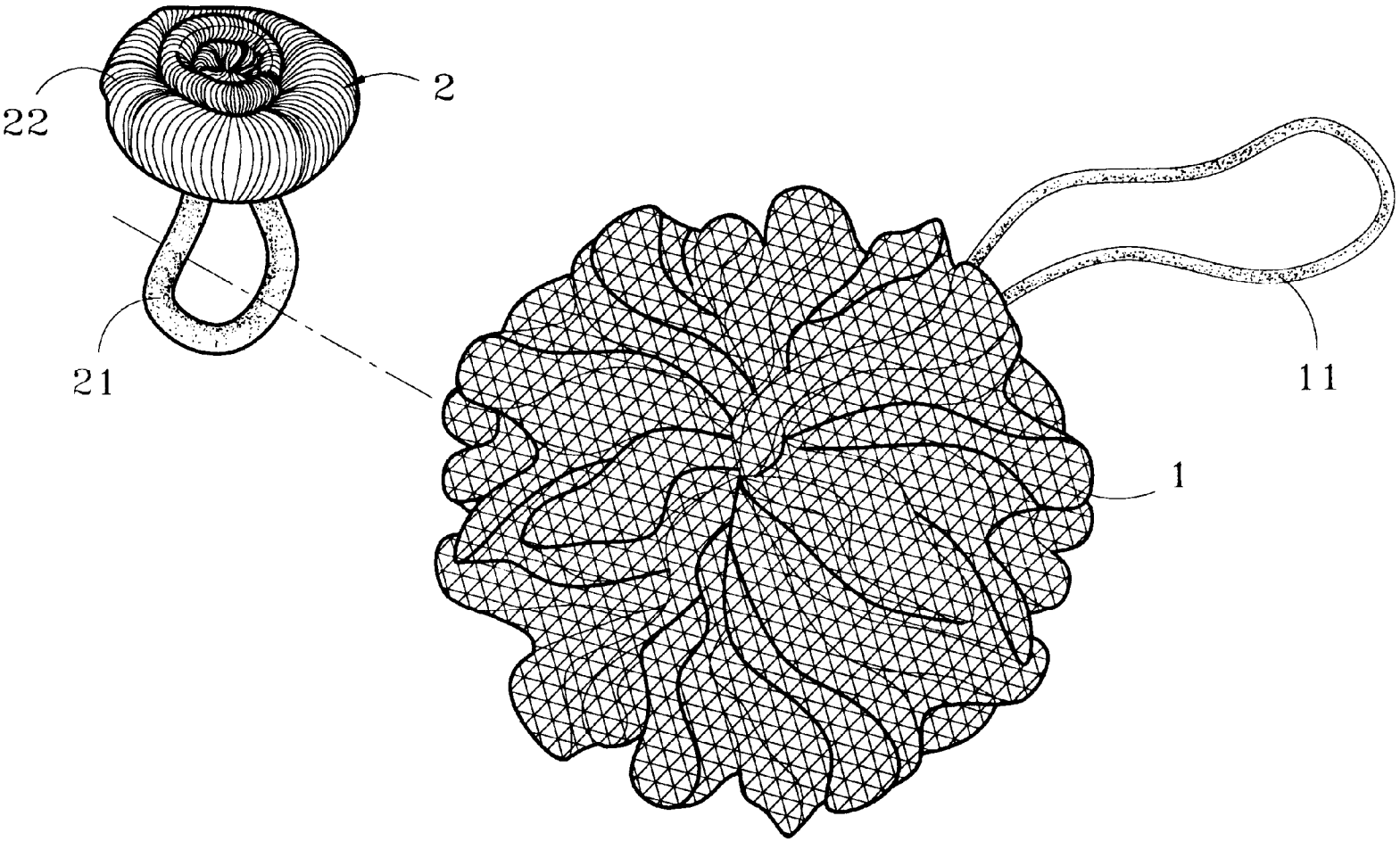
FIG. 5 illustrates another embodiment of this invention.

Referring to FIG. 4 and FIG. 5, the user may hold the stretchable device 21 of the face cleaner 2 directly to clean his face, or use it to fasten his hair when bathing. The face cleaner 2 may be designed diversely according to material of the brush portion 22 for enhancement of beautification of various configurations or patterns to promote consumer's purchasing desire, or it may be detached from the bathing ball 1 for fastening the user's hair during bathing.

Although, this invention has been described in terms of preferred embodiments, it is apparent that numerous variations and modifications may be made without departing from the true spirit and scope thereof, as set forth in the following claims.

What is claimed is:

1. A bathing cleaner comprising:

a substantially spherical bathing ball provided with a shackle extending therefrom;

a face cleaner comprised of a brush portion including a plurality of lobes extending about the periphery thereof and further including a stretchable attachment member extending therefrom;

wherein the stretchable attachment member is looped around a mid-portion of the bathing ball whereby the face cleaner is detachably fastened thereto; and whereby the user can use the bathing ball and face cleaner separately or combined and may also remove the face cleaner and fasten it to his/her hair with the attachment member.

* * * * *